US006343600B1

(12) United States Patent
Steinman

(10) Patent No.: US 6,343,600 B1
(45) Date of Patent: Feb. 5, 2002

(54) FINGER GUARD FOR ARCHERS

(76) Inventor: Jeremy L. Steinman, 3707 N. Maxwell Rd., Pigeon, MI (US) 48755

( * ) Notice: Subject to any disclaimer, the term of this patent is extended or adjusted under 35 U.S.C. 154(b) by 0 days.

(21) Appl. No.: 09/645,382

(22) Filed: Aug. 24, 2000

(51) Int. Cl.[7] ..... F41B 5/14; F41B 5/16
(52) U.S. Cl. ..... 124/91
(58) Field of Search ..... 124/90, 91

(56) References Cited

U.S. PATENT DOCUMENTS 2,910,056 A * 10/1959 Bender ..... 124/91
3,010,447 A * 11/1961 Roemer ..... 124/91
3,135,020 A * 6/1964 Holl et al. ..... 124/91 X
3,331,720 A * 7/1967 Watson ..... 124/91 X
3,375,815 A * 4/1968 Novak ..... 124/91 X
3,756,215 A * 9/1973 Black ..... 124/91
3,937,205 A * 2/1976 Saunders ..... 124/91
5,016,603 A * 5/1991 Tentler ..... 124/91

* cited by examiner

*Primary Examiner*—John A. Ricci
(74) *Attorney, Agent, or Firm*—Reising, Ethington, Barnes, Kisselle, Learman & McCulloch, P.C.

(57) ABSTRACT

A protective member for an archer's fingers has a cylindrical sleeve terminating at one end in an enlarged head having an arcuately convex surface. Two of the members are arranged on an archer's bowstring so that the heads confront one another and are capable of engaging the nock end of an arrow shaft on opposite sides of the latter. The archer's fingers engage the undersurfaces of the heads, rather than the arrow shaft, thereby preventing injury to the archer's fingers.

11 Claims, 1 Drawing Sheet

FIG-1
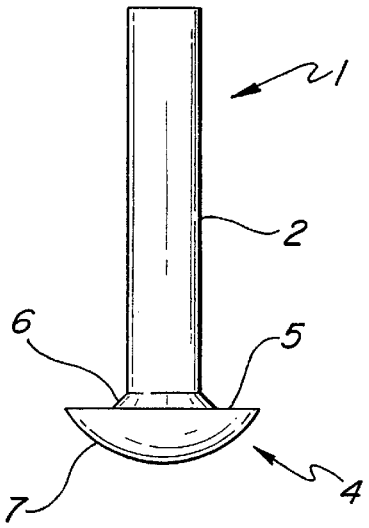
FIG-2
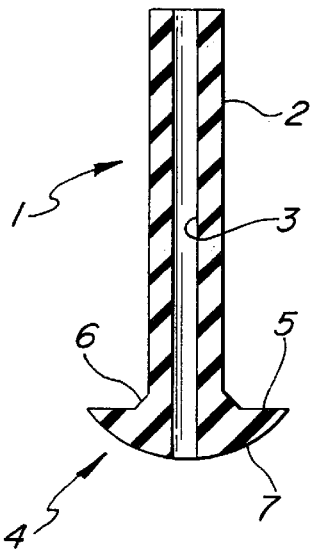
FIG-3
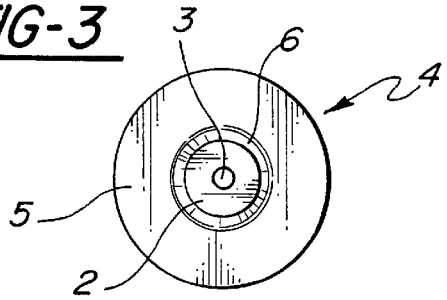
FIG-4
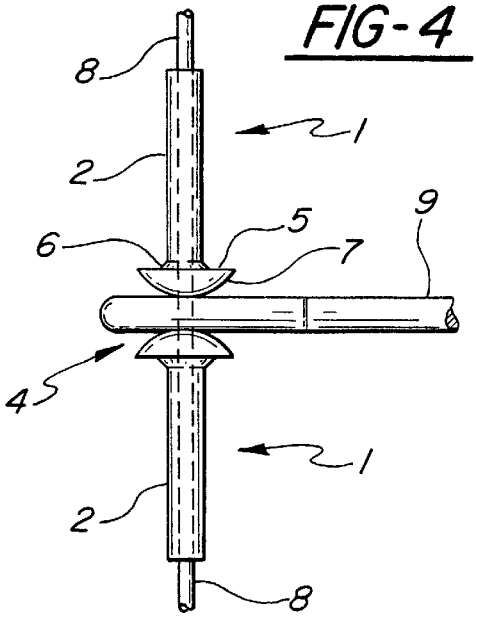
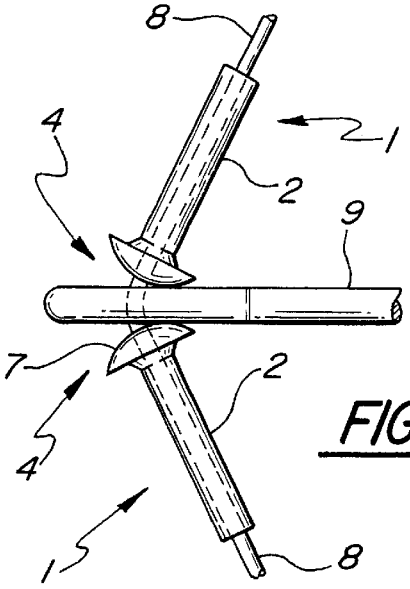
FIG-5

FINGER GUARD FOR ARCHERS

This invention relates to an archer's finger guard construction for protecting the archer's fingers against injury from engagement with the nock of an arrow shaft.

BACKGROUND OF THE INVENTION

An archery arrow conventionally has a shaft having an arrow head or tip at one end, fletching adjacent its opposite end, and a nock at such opposite end which is adapted to accommodate a bowstring.

When an archer prepares to shoot an arrow from a bow he normally places the nocking point of the bowstring in the nock at the rear end of the arrow shaft, grips the nock end of the shaft between two of his fingers, draws the arrow rearwardly, thereby cocking the archery bow, and finally releases the arrow by relaxing his grip on the arrow shaft. The edges of the nock often are fairly sharp as a consequence of which repeated shooting of arrows can cause the archer's fingers to be injured.

The possibility of injuring an archer's fingers as a result of repeatedly shooting arrows has been recognized heretofore and a number of proposals have been made for overcoming the problem. Not all of the proposals have well received, however, for a number of reasons. For example, some protective devices have interfered with the manner in which the bowstring passes out of an arrow's nock, thereby adversely affecting the accuracy of the flight of the arrow. Other protective devices have required an archer's fingers to be spread apart such a distance that the ability to maintain a sufficiently secure grip on the arrow shaft is impaired. Other protective devices require locating the nock end of the arrow on the bowstring in a position which is not the best for accuracy.

An object of this invention is to provide a finger guard which overcomes the disadvantages referred to above.

SUMMARY OF THE INVENTION

A finger guard constructed according to the preferred embodiment of the invention comprises a pair of identical members each of which has a cylindrical sleeve terminating at one end in an enlarged head having a radially extending, flat surface at the juncture of the sleeve, and an arcuately rounded or convex outer surface. An axial bore extends through the sleeve and the head for the accommodation of a bowstring. Each guard member preferably is molded from a rubbery, relatively stiff but deformable material having a high coefficient of friction.

The members comprising the guard device are used in pairs and fitted onto a bowstring in such manner that the head of one member confronts the head of the other member so that the convex surfaces of the heads may engage opposite sides of the nock end of an arrow shaft. The curvature of the arcuate surface of each head is such that, in response to the drawing back of an arrow interposed between the confronting heads, the heads may roll along the surface of the arrow shaft. The two adjacent heads of the protective members may be straddled by the archer's index and middle fingers of one hand, thereby enabling the archer to impose sufficient compressive force on that portion of the arrow shaft which is between the heads as to provide a secure, highly frictional grip on the nock end of the arrow shaft.

When the archer decides to shoot the arrow he relieves the clamping force applied on the arrow shaft by the confronting heads of the two protective members, thereby enabling the arrow to be propelled forwardly.

Since the heads of the protective members are capable of rolling along the opposite sides of the arrow shaft, distortion of the protective members as the bow is cocked is minimized. Consequently, when the frictional force exerted by the protective members on the arrow is relieved, deflection of the arrow due to the recovery from distortion of the protective members also is minimized.

During use of the protective device the archer's fingers will rest upon the flat surfaces of the heads rather than on the arrow shaft. The heads of the protective members thus will be interposed between the archer's fingers and the arrow shaft at all times, thereby preventing engagement between the fingers and the shaft. Consequently, relative movement between the arrow and the archer's fingers does not subject the latter to injury.

THE DRAWINGS

FIG. 1 is an elevational view of one of the protective members constructed in accordance with the invention;

FIG. 2 is a vertical sectional view of the protective member shown in FIG. 1;

FIG. 3 is a plan view of the protective member;

FIG. 4 is a fragmentary view illustrating two of the protective members fitted to an archery bowstring and straddling the nock end of an arrow; and FIG. 5 is a view similar to FIG. 4, but illustrating the parts in positions they occupy when the bow is cocked and just prior to the release of the arrow from the bow.

THE PREFERRED EMBODIMENT

An archer's finger guard member constructed in accordance with the invention is designated generally by the reference character 1 and comprises an elongate, cylindrical stem or sleeve 2 having an axial bore 3 extending therethrough. The sleeve 2 terminates at one end in a unitary, integral, enlarged head 4 having a flat undersurface 5 joined to the sleeve 2 by a truncated, frusto-conical reinforcing section 6. The head extends radially beyond and circumferentially of the sleeve 2. The head 4 has a smoothly arcuate, outwardly convex surface 7 and the bore 3 extends completely through both the sleeve and the head.

The sleeve 2 and the head 4 are molded from a suitable rubbery, resiliently deformable material having a high coefficient of friction. A suitable material is silicone rubber having a desired durometer, such as 60–120.

Protective members 1 constructed in accordance with the invention are used in pairs and applied to the bowstring 8 of an archer's bow (not shown). The bowstring may be threaded through the bore 3 of each member 1 prior to securing both ends of the bowstring to the bow. The members 1 are arranged on the bowstring in such manner that the heads 4 confront one another and thus are capable of straddling and bearing on the nock end of an arrow shaft 9. See FIG. 4.

To condition the apparatus for use, the archer spaces the two members 1 apart a distance sufficient to enable the nock end of the arrow shaft 9 to occupy a position between and in engagement with the heads 4. The bowstring 8 will be fitted into a slot or nock (not shown) at the nock end of the shaft, as is conventional. The archer then may place his index and middle fingers in positions on opposite sides of the arrow shaft and in engagement of the flat surfaces 5 of the heads 4 and cause the two heads to bear forcibly upon the arrow shaft. The archer then may draw the arrow rearwardly of the bow so as to cock the latter. The radial width of the flat surface 5 is such as to prevent the archer's finger from engaging the arrow shaft. Rearward movement of the arrow will cause the bowstring to extend at an acute angle from opposite sides of the arrow, as is shown in FIG. 5.

As the arrow and bowstring are drawn rearwardly, the arcuate surfaces 7 of the heads 4 will rock upon the adjacent surfaces of the arrow, thereby enabling the cylindrical portions 2 of the respective members 1 to remain in substantial alignment with the bowstring 8, rather than being angularly distorted.

The archer must exert sufficient force on the two heads to ensure that the arrow shaft will be clamped between the heads as the bow is cocked. Since the heads are formed of yieldably resilient material, the force applied on the heads will cause the surfaces 7 to be indented to some extent by the arrow shaft, thereby increasing the contact area between the heads and the arrow shaft. Because the coefficient of friction of the heads 4 is greater than that of the arrow shaft 9, the heads 4 will facilitate the archer's gripping of the nock end of the arrow shaft as the arrow and bowstring are drawn rearwardly preparatory to releasing the arrow.

When the arrow is released, the archer's fingers still will be in engagement with the flat surfaces 5 of the heads 4, thereby protecting the fingers from injury by movement of the arrow shaft relative to the archer's fingers.

Since the arcuately convex configuration of the heads 4 enables the members 1 to remain substantially coaxial with the bowstring on opposite sides of the arrow shaft, deformation of the stems 2 due to cocking of the bow is minimized. Consequently the need for recovery of the stems from their deformed condition is lessened. By minimizing deformation of the cylindrical stems 2 of the protective members, the likelihood of inadvertent displacement of the arrow shaft during its release from the bow is greatly reduced.

The disclosed embodiment is representative of the presently preferred embodiment of the invention, but is intended to be illustrative rather than definitive thereof. The invention is defined in the claims.

I claim:

1. A finger guard construction for protecting an archer's fingers against injury by an arrow's nock, said construction comprising a sleeve for the accommodation of a bowstring, said sleeve terminating at one end in an enlarged head extending beyond said sleeve, said head including an arcuately convex surface adapted to bear upon an arrow shaft adjacent the nock thereof, said head having a second surface opposite said convex surface, said second surface extending beyond said sleeve a distance sufficient to prevent inadvertent engagement between an archer's finger and an arrow shaft having a portion thereof in engagement with said arcuate surface.

2. The construction according to claim 1 wherein said sleeve and said head have a bore therein through which a bowstring slideably may pass.

3. The construction according to claim 1 wherein said head is form ed of a deformable, resilient material thereby enabling g said arcuate surface to be deformed in response to engagement with said arrow shaft.

4. The construction according to claim 1 wherein said head is formed of a material having a higher coefficient of friction that that of said arrow shaft.

5. A finger guard construction for protecting an archer's fingers against injury by an arrow's nock, said construction comprising first and second members each having a sleeve joined at one end to an enlarged head extending radially beyond and circumferentially of said one end of said sleeve, each said sleeve and said head having a bore extending therethrough and accommodating a bowstring, said first and second members being so arranged on said bowstring that the head of one of said members confronts the head of the other of said members, each of said heads having an arcuately convex surface adapted to bear against an arrow shaft having a nock through which said bowstring may extend, each said second surface extending beyond its associated sleeve a distance sufficient to prevent inadvertent engagement between an archer's finger and an arrow shaft having a portion thereof between and in engagement with the arcuate surfaces of said heads.

6. The construction according to claim 5 wherein each of said heads has a second surface opposite said convex surface, each said second surface being substantially flat.

7. The construction according to claim 5 wherein each said head is formed of a deformable, resilient material thereby enabling said arcuate surface to be indented in response to forcible engagement with said arrow shaft.

8. The construction according to claim 5 wherein each said head is formed of a material having a higher coefficient of friction than that of said arrow shaft.

9. A finger guard construction for protecting an archer's fingers against injury by an arrow's nock, said construction comprising a sleeve for the accommodation of a bowstring, said sleeve terminating at one end in an enlarged head extending beyond said sleeve, said head including an arcuately convex surface adapted to bear upon an arrow shaft adjacent the nock thereof, said head being formed of a material having a higher coefficient of friction than that of said arrow shaft.

10. A finger guard according to claim 9 wherein said head has a second surface opposite said convex surface and extending beyond said sleeve a distance sufficient to prevent inadvertent engagement between an archer's finger and an arrow shaft having a portion thereof in engagement with the arcuate surface of said head.

11. The construction according to claim 10 wherein said head is formed of a deformable, resilient material enabling said arcuate surface to be indented in response to forcible engagement with said arrow shaft.

* * * * *

UNITED STATES PATENT AND TRADEMARK OFFICE

CERTIFICATE OF CORRECTION

PATENT NO. : 6,343,600 B1
DATED : February 5, 2002
INVENTOR(S) : Jeremy L. Steinman It is certified that error appears in the above-identified patent and that said Letters Patent is hereby corrected as shown below:

Title page,
Item [56], References Cited, change "2,910,056" to -- 2,910,058 --; insert -- 3,135,020 Holl --; insert -- 3,937,205 Saunders --.

Signed and Sealed this

Twelfth Day of November, 2002

*Attest:*

*Attesting Officer*

JAMES E. ROGAN
*Director of the United States Patent and Trademark Office*